US005276492A

United States Patent [19]

Landa et al.

[11] Patent Number: 5,276,492

[45] Date of Patent: Jan. 4, 1994

[54] IMAGING METHOD AND APPARATUS

[75] Inventors: Benzion Landa, Edmonton, Canada; Yehuda Niv, Rehovot, Israel; Amiran Lavon, Bat Yam, Israel; Hanna Pinhas, Holon, Israel; Yossi Adam, Rehovot, Israel; Yakov Krumberg, Rehovot, Israel

[73] Assignee: Spectrum Sciences B.V., Wassenaar, Netherlands

[21] Appl. No.: 829,025

[22] PCT Filed: Jul. 23, 1990

[86] PCT No.: PCT/NL90/00099

§ 371 Date: Feb. 14, 1992

§ 102(e) Date: Feb. 14, 1992

[87] PCT Pub. No.: WO91/03007

PCT Pub. Date: Mar. 7, 1991

Related U.S. Application Data

[63] Continuation-in-part of Ser. No. 393,649, Aug. 14, 1989, Pat. No. 5,047,808, and a continuation-in-part of Ser. No. 400,717, Aug. 30, 1989, and a continuation-in-part of Ser. No. 446,877, Dec. 12, 1989, and a continuation-in-part of Ser. No. 508,287, Apr. 13, 1990, abandoned.

[51] Int. Cl.[5] ..... G03G 15/14

[52] U.S. Cl. ..... 355/277; 219/469; 355/279

[58] Field of Search ..... 355/277, 274, 271, 279, 355/288, 290; 219/216, 469, 470; 430/106, 110

[56] References Cited

U.S. PATENT DOCUMENTS

| | | | |
|---|---|---|---|
| 3,741,643 | 6/1973 | Smith et al. . | |
| 3,767,300 | 10/1973 | Brown et al. . | |
| 3,955,533 | 5/1976 | Smith et al. . | |
| 3,957,016 | 5/1976 | Yamada et al. . | |
| 4,286,039 | 8/1981 | Landa et al. . | |
| 4,582,774 | 4/1986 | Landa . | |
| 4,684,238 | 8/1987 | Till et al. . | |
| 4,690,539 | 9/1987 | Radulski et al. . | |
| 4,708,460 | 11/1987 | Langdon . | |
| 4,794,048 | 12/1988 | Oboodi et al. . | |
| 4,796,048 | 1/1989 | Bean . | |
| 4,897,691 | 1/1990 | Dyer et al. | 355/288 |
| 5,028,964 | 7/1991 | Landa et al. | 355/273 |
| 5,061,583 | 10/1991 | Zwadlo et al. | 430/45 |

*Primary Examiner*—A. T. Grimley
*Assistant Examiner*—T. A. Dang
*Attorney, Agent, or Firm*—Sandler Greenblum & Bernstein

[57] ABSTRACT

A method and apparatus for transferring liquid toner images from an image forming surface (10) to an intermediate transfer member (40) for subsequent transfer to a final substrate (42). the liquid toner images include carrier liquid and pigmented polymeric toner particles which are essentially non-soluble in the carrier liquid at room temperature, and which form a single phase at elevated temperatures. The method includes the steps of: concentrating the liquid toner image by compacting the solids portion of the liquid toner image and removing carrier liquid therefrom; transferring the liquid toner image to the intermediate transfer member (40), heating the liquid toner image on the intermediate transfer member (40) to a temperature at which the toner particles and the carrier liquid form a single phase; and transferring the heated liquid toner image to a final substrate (42).

36 Claims, 2 Drawing Sheets

IMAGING METHOD AND APPARATUS

RELATED APPLICATIONS this application is a continuation-in-part of application Ser. No. 7/393,649 filed Aug. 14, 1989, now U.S. Pat. No. 5,047,808; application Ser. No. 7/400,717 filed Aug. 30, 1989; application Ser. No. 7/446,877 filed Dec. 12, 1989; and application Ser. No. 7/508,287 filed Apr. 13, 1990, now abandoned.

FIELD OF THE INVENTION

The present invention relates to image transfer techniques and apparatus for use in electrophotography.

BACKGROUND OF THE INVENTION

Liquid toner images are developed by varying the density of pigmented solids in a developer material on a latent image bearing surface in accordance with an imaged pattern. The variations in density are produced by the corresponding pattern of electric fields extending outward from the latent image bearing surface. The fields are produced by the different latent image and background voltages on the latent image bearing surface and a voltage on a developer plate or roller.

In general, developed liquid toner images comprise carrier liquid and toner particles and are not homogeneous. Typically, a liquid toner developer contains about 1.5% to 2% solids and a developed image contains about 15% solids. The developed image has a higher density region closer to the latent image bearing surface and a "fluffy", i.e. loosely bound, region further away from the latent image bearing surface.

In order to improve transfer of a developed image from the latent image bearing surface to a substrate, it is most desirable to ensure that, before transfer, the pigmented solids adjacent background regions are substantially removed and that the density of pigmented solids in the developed image is increased, thereby compacting or rigidizing the developed image. Compacting or rigidizing of the developed image increases the image viscosity and enhances the ability of the image to maintain its integrity under the stresses encountered during image transfer It is also desirable that excess liquid be removed from the latent image bearing surface before transfer.

It is known in the prior art, as described in U.S. Pat. No. 3,955,533, to employ a reverse roller spaced about 50 microns from the latent image bearing surface to shear off the carrier liquid and pigmented solids in the region beyond the outer edge of the image and thus leave relatively clean areas above the background.

The technique of removing carrier liquid is known generally as metering. An alternative metering technique, described in U.S. Pat. Nos. 3,767,300 and 3,741,643, employs an air knife, but has not been particularly successful due to sullying of the background as a result of turbulence. Corona discharge has also been used to compress and remove liquid from a developed liquid image.

In U.S. Pat. No. 3,957,016, the use of a positive biased metering roller is proposed wherein the metering roller is maintained at a voltage intermediate the image and background voltages to clean the background while somewhat compacting the image.

In the prior art it is known to effect image transfer from a photoreceptor onto a substrate backed by a charged roller. Unless the image is rigidized before it reaches the nip of the photoreceptor and the roller, image squash and flow may occur. This is particularly true if the substrate is a non-porous material, such as plastic.

In the prior art, liquid toner images are generally transferred to substrates by electrophoresis, whereby the charged image moves from the latent image bearing surface to the substrate through the carrier liquid under the influence of an electric field produced by a high voltage, associated with the substrate, which is of opposite polarity to the charge on the image particles.

The voltage and thus the field strength available for electrophoretic transfer are limited by the danger of electrical breakdown which can occur at both the input and output edges of the nip, due to the minimum of the Paschen curve being at about 8 microns. Thus, according to the Paschen curve, the voltage difference at the nip preferably should not exceed about 360 volts, in order to avoid electrical breakdown and possible damage to the image and latent image bearing surface.

Electrophoretic compaction of images prior to transfer thereof is described in U.S. Pat. No. 4,286,039 which shows a metering roller followed by a negatively biased squeegee roller. The squeegee roller is operative both for compacting the image and for removing excess liquid.

U.S. Pat. Nos. 4,690,539 and 4,708,460 describe apparatus for removing substantially all of the carrier liquid from a liquid image on an image transfer member, prior to transfer to the final substrate.

U.S. Pat. No. 4,684,238 describes the use of an electrified roller spaced away from a liquid image on an intermediate transfer member. The stated object of this mechanism is the compacting of the image and the removal of liquid therefrom.

U.S. Pat. No. 4,796,048 describes a system for transferring a liquid toner image from a photoconductor to an image transfer member. The image transfer member is urged against the photoconductor during transfer to squeegee carrier liquid away from the non-image areas. The image areas are kept in a spaced relationship from the intermediate transfer member by spacer particles in the toner material as described in U.S. Pat. No. 4,582,774. This toner material is the only toner described in U.S. Pat. No. 4,796,048 as being a suitable toner.

SUMMARY OF THE INVENTION

The present invention seeks to provide improved apparatus for enhancement of image transfer.

In a preferred embodiment of the invention a liquid toner image is transferred from an image forming surface to an intermediate transfer member for subsequent transfer to a final substrate. The liquid toner image includes a liquid portion including carrier liquid and a solids portion including pigmented polymeric toner particles which are essentially non-soluble in the carrier liquid at room temperature, and the polymer portion of which forms substantially a single phase with carrier liquid at elevated temperatures. An imaging method is provided which includes the steps of concentrating the liquid toner image to a given non-volatile solids percentage by compacting the solids portion thereof and removing carrier liquid therefrom; transferring the liquid toner image to an intermediate transfer member; heating the liquid toner image on the intermediate transfer member to a temperature at least as high as that at which the polymer portion of the toner particles and the carrier liquid form substantially a single phase at the given solids percentage; and transferring the heated liquid toner image to a final substrate.

In a preferred embodiment of the invention a liquid toner image is transferred from an image forming surface to an intermediate transfer member for subsequent transfer to a final substrate. The liquid toner image includes a liquid portion including carrier liquid and a solids portion including toner particles. An imaging method is provided which includes the steps of concentrating the liquid toner image by compacting the solids portion thereof and removing carrier liquid therefrom such that the image has a non-volatile solids percentage of between 20% and 35%; transferring the liquid toner image to an intermediate transfer member; and transferring the liquid toner image to a final substrate.

In a preferred embodiment of the invention, the step of concentrating includes the simultaneous application of an electric field to compact the solids portion of the image and of pressure to remove liquid from the image.

In preferred embodiments of the invention the non-volatile solids percentage can be about 20, 25%, 30% or 35% or greater after the step of concentration.

In a preferred embodiment of the invention the single phase is a liquid phase. Alternatively or additionally, in a preferred embodiment of the invention the step of concentrating is operative to increase the solids percentage to a value at which phase separation cannot occur.

There is also provided, in a preferred embodiment of the invention, imaging apparatus utilizing a liquid developer comprising carrier liquid and pigmented polymeric toner particles which are essentially non-soluble in the carrier liquid at room temperature, and the polymer portion of which form substantially a single phase with carrier liquid at elevated temperatures, the apparatus including: an image forming surface, apparatus, utilizing the liquid developer, for forming a liquid toner image having a liquid portion including carrier liquid and a solids portion including toner particles, on the image forming surface, apparatus for concentrating the liquid toner image to a given non-volatile solids percentage by compacting the solids portion of the liquid toner image and removing carrier liquid therefrom; apparatus for transferring the liquid toner image to an intermediate transfer member after concentration thereof, apparatus for heating the liquid toner image on the intermediate transfer member to a temperature at least as high as that at which the polymer portion of the toner particles and the carrier liquid form substantially a single phase at the given concentration and apparatus for transferring the liquid toner image, after heating thereof, to a final substrate.

There is further provided in a preferred embodiment of the invention, imaging apparatus utilizing a liquid developer, the apparatus including: an image forming surface, apparatus utilizing the liquid developer, for forming a liquid toner image having a liquid portion including carrier liquid and a solids portion including toner particles, on the image forming surface, apparatus for concentrating the liquid toner image by compacting the solids portion thereof and removing carrier liquid therefrom, including apparatus for increasing the non-volatile solids percentage of the liquid toner image to between 20% and 35%, apparatus for transferring the liquid toner image to an intermediate transfer member and apparatus for transferring the liquid toner image from the intermediate transfer member to a final substrate.

In a preferred embodiment of the invention the apparatus for concentrating includes apparatus for the simultaneous application of an electric field to compact the solids portion of the image and of mechanical pressure to remove liquid from the image. In a preferred embodiment of the invention the apparatus for concentrating includes an electrified squeegee roller urged against the image forming surface.

In a preferred embodiment of the application the single phase is a liquid phase. Alternatively or additionally, the apparatus for concentrating is operative to increase the solids percentage to a value at which phase separation cannot occur.

In a preferred embodiment of the invention the imaging apparatus also includes optical radiation apparatus for discharging both image and background areas prior to image transfer to the image transfer member. In a preferred embodiment of the invention the optical radiation apparatus includes at least one light emitting diode. In a preferred embodiment, the optical radiation apparatus includes at least two radiation sources radiating different color light.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
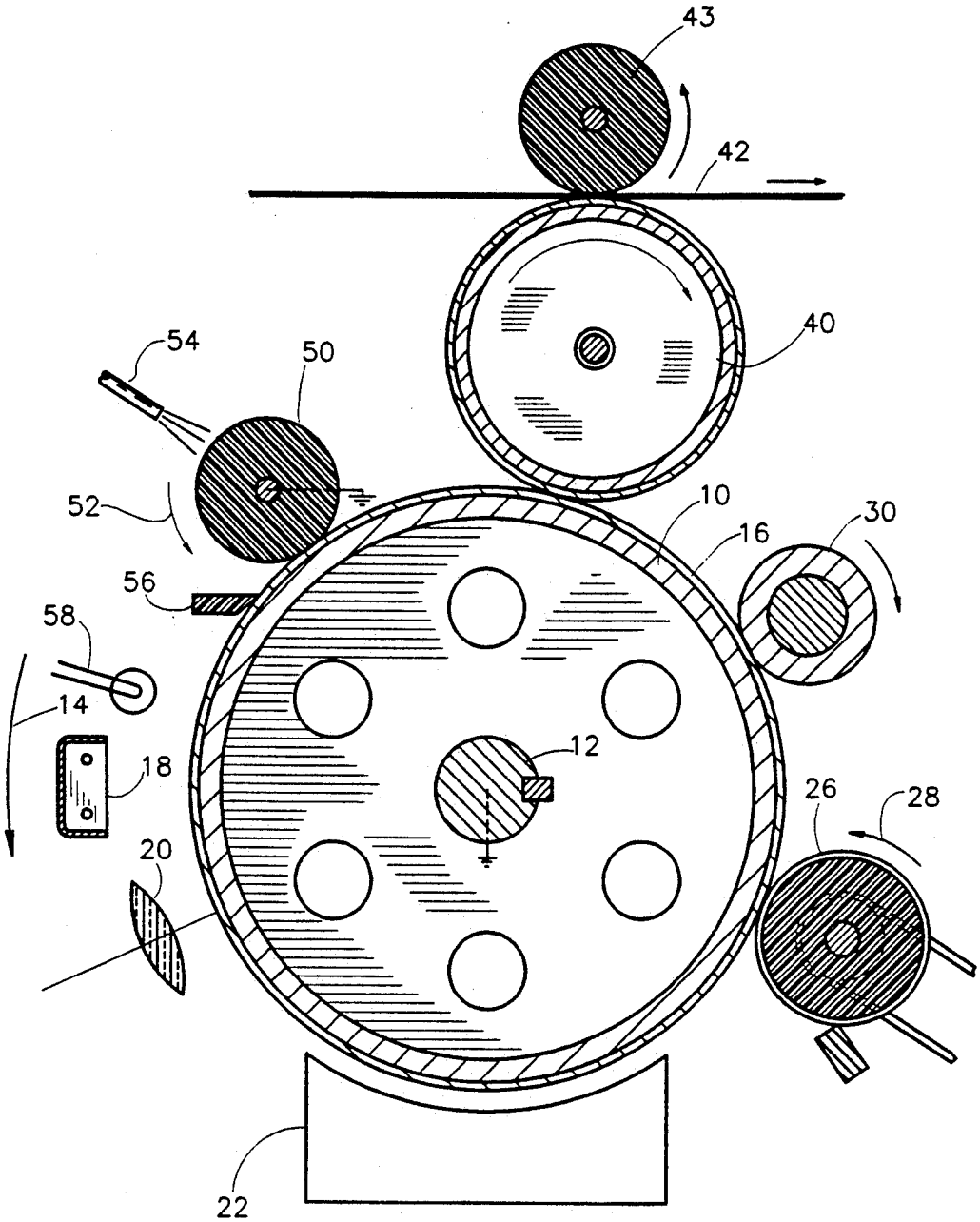
FIG. 1 is a simplified sectional illustration of electrophotographic apparatus constructed and operative in accordance with a preferred embodiment of the present invention.

Reference is now made to FIG. 1 which illustrates electrophotographic imaging apparatus constructed and operative in accordance with a preferred embodiment of the present invention. The invention is described for liquid developer systems with negatively charged toner particles, and negatively charged photoconductors, i.e., systems operating in the reversal mode. For other combinations of toner particle and photoconductor polarity, the values and polarities of the voltages are changed, in accordance with the principles of the invention.

Figure 2:
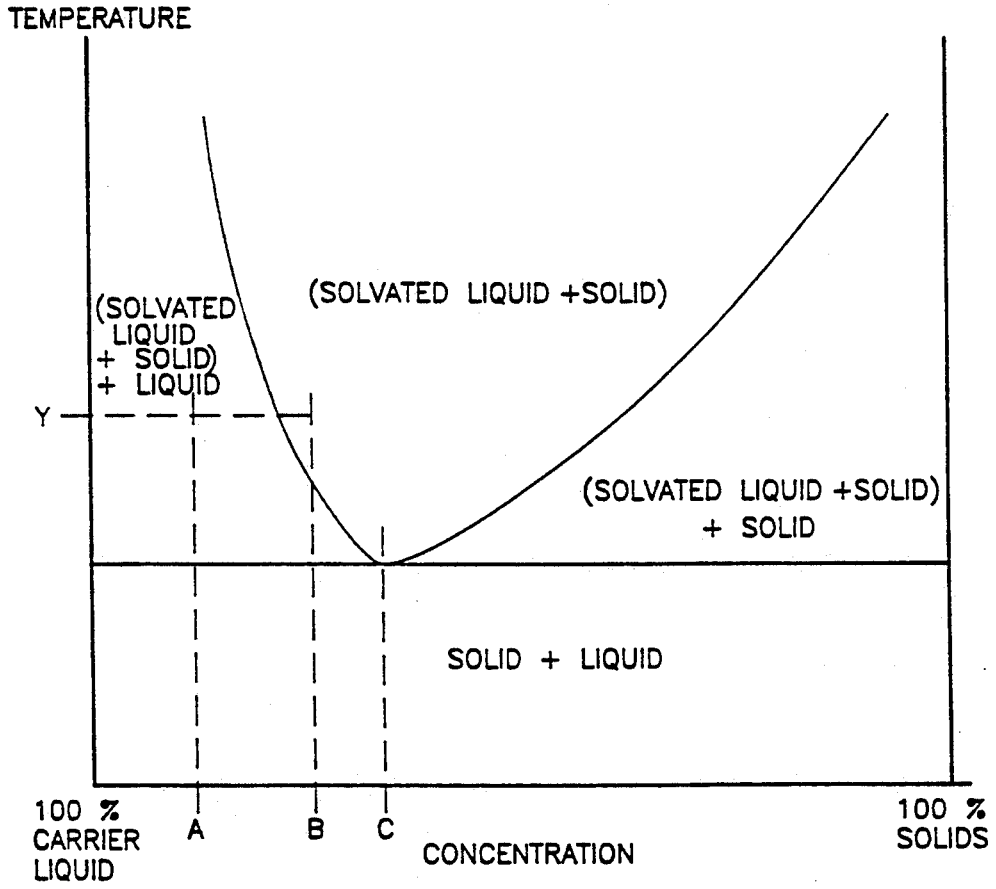
FIG. 2 is part of a partial simplified typical phase diagram for a preferred liquid toner for the present invention.

The invention can be practiced using a variety of liquid developer types but is especially useful for liquid developers comprising carrier liquid and pigmented polymeric toner particles which are essentially non-soluble in the carrier liquid at room temperature, and which solvate carrier liquid at elevated temperatures. This is a characteristic of the liquid developer of Example 1 of U.S. Pat. No. 4,794,651, the disclosure of which is included herein by reference. Part of a simplified phase diagram of a typical toner of this type is shown in FIG. 2. This diagram represents the states of the polymer portion of the toner particles and the carrier liquid. The pigment in the particles generally takes little part in the process, and references herein to "single phase" and to "solvation" refer to the state of the polymer part of the toner particles together with the carrier liquid.

In a preferred embodiment of the invention a liquid developer is prepared by mixing 10 parts of Elvax II 5950 (E. I. du Pont) and 5 parts by weight of Isopar L (Exxon) at low speed in a jacketed double planetary mixer connected to an oil heating unit for one hour, the heating unit being set at 130° C. A mixture of 2.5 parts by weight of Mogul L carbon black (Cabot) and 5 parts by weight of Isopar L is then added to the mix in the double planetary mixer and the resultant mixture is further mixed for one hour at high speed. 20 parts by weight of Isopar L pre-heated to 110° C. are added to the mixer and mixing is continued at high speed for one hour. The heating unit is disconnected and mixing is continued until the temperature of the mixture drops to 40° C.

100 g of the resulting material is mixed with 120 g of Isopar L and the mixture is milled for 19 hours in an attritor to obtain a dispersion of particles. The material is dispersed in Isopar L to a solids content of 1.5% by weight.

The preferred liquid developer prepared comprises toner particles which are formed with a plurality of fibrous extensions or tendrils as described in U.S. Pat. No. 4,794,651, the disclosure of which is incorporated herein by reference. The preferred liquid developer is characterized in that when the concentration of toner particles is increased above 20%, the viscosity of the material increases greatly, apparently in approximately an exponential manner.

A charge director, prepared in accordance with Example of assignee's co-pending U.S. patent application Ser. No. 354,121 filed Apr. 22, 1989 and entitled HUMIDITY TOLERANT CHARGE DIRECTOR MATERIALS, the disclosure of which is incorporated herein by reference, is added to the dispersion in an amount equal to about 3% of the weight of the solids in the developer.

As in conventional electrophotographic systems, the apparatus of FIG. 1 typically comprises a drum 10 arranged for rotation about an axle 12 in a direction generally indicated by arrow 14. Drum 10 is formed with a cylindrical photoconductor surface 16.

A corona discharge device 18 is operative to generally uniformly charge photoconductor surface 16 with a negative charge. Continued rotation of drum 10 brings charged photoconductor surface 16 into image receiving relationship with an exposure unit including a lens 20, which focuses an image onto charged photoconductor surface 16, selectively discharging the photoconductor surface, thus producing an electrostatic latent image thereon. The latent image comprises image areas at a given range of potentials and background areas at a different potential. The image may be laser generated as in printing from a computer or it may be the image of an original as in a copier.

Continued rotation of drum 10 brings charged photoconductor surface 16, bearing the electrostatic latent image, into a development unit 22, which is operative to apply liquid developer, comprising a solids portion including pigmented toner particles and a liquid portion including carrier liquid, to develop the electrostatic latent image. The developed image includes image areas having pigmented toner particles thereon and background areas. Development unit 22 may be a single color developer of any conventional type, or may be a plurality of single color developers for the production of full color images as is known in the art. Alternatively, full color images may be produced by changing the liquid toner in the development unit when the color to be printed is changed. Alternatively, highlight color development may be employed, as is known in the art.

In accordance with a preferred embodiment of the invention, following application of toner thereto, photoconductor surface 16 passes a typically charged rotating roller 26, preferably rotating in a direction indicated by an arrow 28. Typically the spatial separation of the roller 26 from the photoconductor surface 16 is about 50 microns. Roller 26 thus acts as a metering roller as is known in the art, reducing the amount of carrier liquid on the background areas and reducing the amount of liquid overlaying the image.

Preferably the potential on roller 26 is intermediate that of the latent image areas and of the background areas on the photoconductor surface. Typical approximate voltages are: roller 26: −500 V, background area: −1000 V and latent image areas: −150 V.

The liquid toner image which passes roller 26 should be relatively free of pigmented particles except in the region of the latent image.

Downstream of roller 26 there is preferably provided a rigidizing roller 30. Rigidizing roller 30 is preferably formed of resilient polymeric material, such as polyurethane which may have only its natural conductivity or which may be filled with carbon black to increase its conductivity.

According to one embodiment of the invention, roller 30 is urged against photoconductor surface 16 as by a spring mounting (not shown). The surface of roller 30 typically moves in the same direction and with the same velocity as the photoconductor surface to remove liquid from the image.

Preferably, the biased squeegee described in U.S. Pat. No. 4,286,039, the disclosure of which is incorporated herein by reference, is used as the roller 30. Roller 30 is biased to a potential of at least several hundred and up to several thousand Volts with respect to the potential of the developed image on photoconductor surface 16, so that it repels the charged pigmented particles and causes them to more closely approach the image areas of photoconductor surface 16, thus compacting and rigidizing the image.

In a preferred embodiment of the invention, rigidizing roller 30 comprises an aluminum core having a 20 mm diameter, coated with a 4 mm thick carbon-filled polyurethane coating having a Shore A hardness of about 30–35, and a volume resistivity of about $10^8$ ohm-cm. Preferably roller 30 is urged against photoconductor surface 16 with a pressure of about 40–70 grams per linear cm of contact, which extends along the length of the drum. The core of rigidizing roller 30 is energized to between about −1800 and −2800 volts, to provide a voltage difference of preferably between about 1600 and 2700 volts between the core and the photoconductor surface in the image areas. Voltage differences of as low as 600 volts are also useful.

After rigidization under these conditions and for the preferred toner, the solids percentage in the image portion is believed to be as high as 35% or more, when carrier liquid absorbed as plasticizer is considered as part of the solids portion. It is preferable to have an image with at least 25–30% solids, after rigidizing. When the solids percentage is calculated on a non-volatile solids basis, the solids percentage is preferably above 20% and is usually less than 30%. Values of 25% have been found to be especially useful. At these concentrations the material has a paste like consistency.

Alternatively, the carbon filled polyurethane can be replaced by unfilled polyurethane with a volume resistivity of about $3\times10^{10}$, and the voltage is adjusted to give proper rigidizing.

Downstream of rigidizing roller 30 there is preferably provided a plurality of light emitting diodes (LEDs) 29 to discharge the photoconductor surface, and equalize the potential between image and background areas. For process color systems, where yellow, magenta and cyan toners are used, both red and green LEDs are provided to discharge the areas of the photoconductor behind the developed image as well as the background areas.

Downstream of LEDs 29 there is provided an intermediate transfer member 40, which rotates in a direction opposite to that of photoconductor surface 16, as shown by arrow 41. The intermediate transfer member is operative for receiving the toner image from the photoconductor surface and for subsequently transferring the toner image to a receiving substrate 42, such as paper.

Various types of intermediate transfer members are known and are described, for example, in U.S. Pat. No. 4,684,238 and in assignee's copending U.S. patent applications Ser. No. 293,456 entitled METHOD AND APPARATUS FOR IMAGING USING AN INTERMEDIATE TRANSFER MEMBER filed Jan. 4, 1989, and Ser. No. 306,076 entitled IMAGING SYSTEM WITH RIGIDIZER AND INTERMEDIATE TRANSFER MEMBER the disclosures of which are incorporated herein by reference.

In general, intermediate transfer member 40 is urged against photoconductor surface 16. One of the effects of the rigidization described above is to prevent substantial squash or other distortion of the image caused by the pressure resulting from the urging. The rigidization effect is especially pronounced due to the sharp increase of viscosity with concentration for the preferred toner.

Transfer of the image to intermediate transfer member is preferably aided by providing electrical bias to the intermediate transfer member 40 to attract the charged toner thereto, although other methods known in the art may be employed. Subsequent transfer of the image to substrate 42 is preferably aided by heat and pressure, with pressure applied by a backing roller 43, although other methods known in the art may be employed.

It has been noted that when the negatively biased squeegee roller of U.S. Pat. No. 4,286,039, with high negative voltage, is utilized as the roller 30, the voltage difference between the intermediate transfer member and the photoconductor surface, required to transfer the image to the intermediate transfer member is sharply reduced. It is believed that this reduction is possibly due to current flow tending to equalize and discharge the potential of image and background areas on the image bearing surface. LEDs 29 discharge both image and non-image areas and are operative to further reduce this voltage difference.

For the particular illustrative example described herein, the intermediate transfer member voltage is between −300 V and 0 V where no pre-transfer LEDs are used and between +200 V and +500 V where they are used.

Following transfer of the toner image to the intermediate transfer member, photoconductor surface 16 is engaged by a cleaning roller 50, which typically rotates in a direction indicated by an arrow 52, such that its surface moves in a direction opposite to the movement of adjacent photoconductor surface 16 which it operatively engages. Cleaning roller 50 is operative to scrub and clean surface 16. A cleaning material, such as toner, may be supplied to the cleaning roller 50, via a conduit 54. A wiper blade 56 completes the cleaning of the photoconductor surface. Any residual charge left on photoconductor surface 16 is removed by flooding the photoconductor surface with light from a lamp 58.

In a multi-color system, subsequent to completion of the cycle for one color, the cycle is sequentially repeated for other colors which are sequentially transferred from photoconductor surface 16 to intermediate transfer member 40. The single color images may be sequentially transferred to the paper, in alignment, or may alternatively be overlaid on the intermediate transfer member and transferred as a group to substrate 42.

Details of the construction of the surface layers of preferred intermediate transfer members are shown in assignee's U.S. patent application Ser. No. 393,631, entitled IMAGE TRANSFER APPARATUS INCORPORATING AN INTEGRAL HEATER, the disclosure of which is incorporated herein by reference.

Generally, the image is heated on intermediate transfer member 40 in order to facilitate its transfer to substrate 42. This heating is preferably to a temperature above a threshold temperature of substantial solvation of the carrier liquid in the toner particles.

As seen in FIG. 2, when the image is heated, the state of the image, i.e. of the polymer portion of the toner particles and the carrier liquid, depends on several factors, mainly on the temperature of the intermediate transfer member and on the concentration of toner particles. Thus, if the percentage of toner particles is "A" and the intermediate transfer member temperature is "Y" the liquid image separates into two phases, one phase being substantially a liquid polymer/carrier-liquid phase and the other phase consisting mainly of carrier liquid. On the other hand, if the percentage of toner particles is "B" at the same temperature, then substantially only one phase, a liquid polymer/carrier-liquid phase will be present. It is believed to be preferable that separate liquid polymer/carrier-liquid and liquid phases do not form to any substantial degree, as will be the case for example if the concentration is "C".

This type of phase separation is believed to be undesirable on the intermediate transfer member. It is believed that an absence of substantial phase separation of this type in the image on the intermediate transfer member results in improved image quality, including an improvement in line uniformity.

It is understood that heating the image on the intermediate transfer member is not meant to completely dry the image, although some evaporation of carrier liquid may result. Rather, the image on the intermediate transfer member remains a viscous liquid until its transfer to the final substrate.

The invention has been described by a specific embodiment utilizing an electrified squeegee roller for concentrating the liquid toner image on the photoconductor surface. Alternatively other methods of concentrating the image, i.e., compacting the solids portion thereof and removing liquid therefrom, can be utilized provided they concentrate the image to the extent required. These methods include the use of separate solids portion compactors and liquid removal means, such as those described in U.S. patent application Ser. No. 306,076, previously incorporated herein by reference. Alternatively the apparatus may utilize a solids portion compactor followed by an intermediate transfer member urged against the photoconductor to remove liquid from the image. As a further alternative, the commutated intermediate transfer member described in U.S. patent application Ser. No. 306,076 may be used to provide both solids portion compacting and liquid removal, just prior to transfer to the intermediate transfer member.

Furthermore the concentrating step may take place on the intermediate transfer member after transfer of the liquid toner image thereto and before heating the image.

It will be appreciated by persons skilled in the art that the present invention is not limited by what has been particularly shown and described hereinabove. Rather the scope of the present invention is defined only by the claims which follow:

We claim:

1. A method for transferring a liquid toner image including a liquid portion comprising carrier liquid and a solids portion which includes pigmented polymeric toner particles being essentially non-soluble in the carrier liquid at room temperature, said method for transferring being operative to transfer the liquid toner image from an image forming surface to a final substrate, and comprising the steps of:

concentrating the liquid toner image to a given non-volatile solids percentage by compacting the solids portion thereof and removing carrier liquid therefrom such that the particles and the carrier liquid form a single phase at a given toner temperature;

transferring the liquid toner image to an intermediate transfer member;

heating the liquid toner image on the intermediate transfer member to a given temperature at least as high as that at which the toner particles and carrier liquid at the given solids percentage form substantially a single phase; and transferring the liquid toner image to the final substrate.

2. A method according to claim 1, wherein said single phase is a liquid phase.

3. A method according to claim 1, wherein said step of concentrating is operative to increase said solids percentage to a value at which phase separation cannot occur.

4. A method according to claim 1 wherein said solids percentage is above about 20%.

5. A method for transferring a liquid toner image comprising a solids potion and a liquid portion from an image forming surface to a final substrate comprising the steps of:

concentrating the liquid toner image to a non-volatile solids percentage of between 20 and 35% by compacting the solids portion thereof and removing carrier liquid therefrom;

transferring the liquid toner image to an intermediate transfer member after the step of concentrating; and transferring the liquid toner imae to the final substrate after the step of concentrating.

6. A method according to claim 1 wherein said step of concentrating comprises a simultaneous application of an electric field to compact the solids portion of the liquid toner image and of mechanical pressure to remove liquid from the imae.

7. A method according to claim 1 wherein said solids percentage is below about 30%.

8. A method according to claim 7 wherein said solids percentage is about 25%.

9. A method according to claim 1 wherein said step of concentrating precedes said step of transferring the liquid toner image to the intermediate transfer member.

10. A method according to claims 1 and also including the step of irradiating the image with optical radiation.

11. A method according to claim 10 wherein said optical radiation includes radiation from at least two radiation sources radiating different color light.

12. Image apparatus utilizing a liquid developer comprising carrier liquid and pigmented polymeric toner particles which are essentially non-soluble in the carrier liquid at room temperature the apparatus comprising:

an image forming surface;

means utilizing said liquid developer, for forming a liquid toner image comprising a liquid portion comprising carrier liquid and a solids portion comprising toner particles on said image forming surface;

means for concentrating the liquid toner image by compacting the solids portion of the liquid toner image and removing a portion of the carrier liquid therefrom to form a liquid image having a given non-volatile solids percentage wherein said toner particles form substantially a single phase with the remaining carrier liquid at an elevated temperature;

means for transferring the liquid toner image to an intermediate transfer member after concentration thereof; and means or heating the liquid toner image on the intermediate transfer member to a given temperature at least as high as that at which the toner particles and the remaining carrier liquid form substantially a single phase at the given solids percentage; and means for transferring the liquid toner image after heating thereof to a final substrate.

13. Apparatus according to claim 12, wherein said single phase is a liquid phase.

14. Apparatus according to claim 13, wherein said means or concentrating is operative to increase said solids percentage to a value at which phase separation cannot occur.

15. Apparatus according to claim 12 wherein said solids percentage is above about 20%.

16. Imaging apparatus utilizing a liquid developer, said apparatus comprising:

an image forming surface;

means, utilizing said liquid developer, for forming a liquid toner image comprising a liquid portion comprising carrier liquid and a solids portion comprising toner particles, on said image forming surface;

means for concentrating the liquid toner image to a non-volatile solids percentage of said liquid toner image to between about 20% and 35% by compacting the solids portion thereof and removing carrier liquid therefrom;

means for transferring the liquid toner image to an intermediate transfer member; and means for transferring the liquid toner image to a final substrate from the intermediate transfer member.

17. Apparatus according to claim 12 wherein said means for concentrating includes means for effacing a simultaneously application of an electric field to compact the solids portion of the liquid toner image and of mechanical pressure to remove liquid from the image.

18. Apparatus according to claim 12 wherein said means for concentrating comprises a electrified squeegee roller urged against said image forming surface.

19. Apparatus according to claim 12, wherein said solids percentage is below about 30%.

20. Apparatus according to claim 12, wherein said solids percentage is about 25%.

21. Apparatus according to claim 12 and also including optical radiation means (29) for discharging both image and background areas prior to image transfer to said image transfer member.

22. Apparatus according to claim 21 wherein said optical radiation means includes at least one light emitting diode.

23. Apparatus according to claim 21 wherein said optical radiation means includes at least two radiation sources radiating different color light.

24. A method according to claim 5 wherein said step of concentrating comprises a simultaneous application of an electric field to compact the solids portion of the liquid toner image and of mechanical pressure to remove liquid from the image.

25. A method according to claim 5 wherein said solids percentage is below bout 30%.

26. A method according of claim 25 wherein said solids percentage is about 25%.

27. A method according to claim 5 wherein said step of concentrating precedes said step of transferring the liquid image to the intermediated transfer member.

28. A method according to claim 1 and also including the step of irradiating the liquid toner image with optical radiation.

29. A method according to claim 28 wherein said optical radiation includes radiation from at least two radiation sources radiating different color light.

30. Apparatus according to claim 16 wherein said means for concentrating includes means for effacing a simultaneous application of an electric field to compact the solids portion of the liquid toner image and of mechanical pressure of remove liquid from the image.

31. Apparatus according of claim 16 wherein said means for concentrating comprises a electrified squeegee roller urged against said image forming surface.

32. Apparatus according to claim 16, wherein said solids percentage is below about 30%.

33. Apparatus according to claim 16, wherein said solids percentage is about 25%.

34. Apparatus according to claim 16 and also including optical radiation mans or discharging both image and background areas prior to image transfer to said image transfer member.

35. Apparatus according to claim 34 wherein said optical radiation means includes at least one light emitting diode.

36. Apparatus according to claim 34 wherein said optical radiation means includes at least two radiation sources radiating different color light.

* * * * *